United States Patent [19]

Karlotski et al.

[11] Patent Number: 4,498,027

[45] Date of Patent: Feb. 5, 1985

[54] ARC DISCHARGE LAMP WITH IMPROVED STARTING CAPABILITIES, IMPROVED EFFICACY AND MAINTENANCE, AND LINE-OF-SIGHT ARCHED ARC TUBE FOR USE THEREWITH

[75] Inventors: Robert J. Karlotski, Hillsboro; Ronald C. Lekebush, Goffstown; Joseph S. Kulik, Jr., Allenstown, all of N.H.

[73] Assignee: GTE Products Corporation, Stamford, Conn.

[21] Appl. No.: 387,407

[22] Filed: Jun. 11, 1982

[51] Int. Cl.[3] ..... H01J 61/30; H01J 61/32

[52] U.S. Cl. ..... 313/634; 313/621

[58] Field of Search ..... 313/634, 621

[56] References Cited

U.S. PATENT DOCUMENTS

| | | | |
|---|---|---|---|
| 2,190,657 | 2/1940 | Germer | 313/570 |
| 2,205,000 | 6/1940 | Spanner | 315/50 X |
| 3,858,078 | 12/1974 | Koury | 313/634 |
| 3,900,237 | 8/1975 | Marcucci | 313/634 X |
| 4,056,751 | 11/1977 | Gungle et al. | 313/634 |

OTHER PUBLICATIONS

Koury et al., "A New Generation of Metal Halide Lamps", Journal of the IES, vol. 4, No. 2, pp. 106–110, Jan. 1975.

*Primary Examiner*—David K. Moore
*Assistant Examiner*—Vincent DeLuca
*Attorney, Agent, or Firm*—Joseph S. Romanow

[57] ABSTRACT

A line-of-sight arched arc tube of an arc discharge lamp; e.g., a metal halide arc discharge lamp for horizontal operation having an arched upper wall to accommodate the bowing of the arc discharge during full temperature and pressure operation of the lamp and a lower wall of lesser curvature to accommodate the arc discharge during lamp start and warm-up. The curvature of the lower wall is such that there is a straight line-of-sight between the primary electrodes without being impeded by the lower wall of the arc tube and such that temperature profiles over the body of the arc tube are optimized during full temperature and pressure operation of the lamp.

6 Claims, 2 Drawing Figures

ARC DISCHARGE LAMP WITH IMPROVED STARTING CAPABILITIES, IMPROVED EFFICACY AND MAINTENANCE, AND LINE-OF-SIGHT ARCHED ARC TUBE FOR USE THEREWITH

TECHNICAL FIELD

This invention relates to arc discharge lamps and more particularly to such lamps which are used in horizontal operation and have arched arc tubes.

BACKGROUND ART

Arc discharge lamps comprise an hermetically sealed arc tube and a fill within the arc tube. The fill generally comprises mercury; an inert gas, for starting purposes; and in the more recent art, one or more metal halides to improve the efficacy and color-rendering properties of the lamp. These lamps are well known and frequently employed in commercial usage because of their long life, about 10,000 to 20,000 hours depending on wattage, and their high efficacy. The efficacy of lamps is usually measured in lumens per watt and will be so designated herein. Metal halide arc lamps have efficacies in the neighborhood of 80 to 125 lumens per watt depending on the wattage.

The arc tube in arc discharge lamps is generally made of fused quartz or a high silica glass, e.g., Vycor. The arc tube generally is a straight or arched cylindrical tube having press seals at each end. When the arc tube is a straight cylinder, positional orientation of the arc tube during lamp operation is not essential.

During normal lamp operation, the temperature of the arc tube can range between 500° and 1000° C. and the pressure within the arc tube can range between 1 and 30 atmospheres. When a lamp with a straight arc tube is operated horizontally, convection currents within the arc tube cause the arc discharge to arch or bow upwards resulting in higher temperatures at the upper wall of the arc tube. This phenomenon results in lower lamp efficacy. Also, increased upper-wall temperature results in increased sodium losses and quartz-electrode reactions.

In U.S. Pat. No. 3,858,078, issued Dec. 31, 1974, Koury taught that the efficacy and lumen maintenance of a metal halide arc discharge lamp operating in a horizontal position can be improved by modifying the geometry of the arc tube such that the arc tube is arched to accommodate the bowing of the arc discharge during full temperature and pressure operation of the lamp. The significant improvements disclosed in the Koury patent, which are still current in the art, are based on the principle that arc tube walls should be designed such that they will be substantially parallel and equidistant from the longitudinal axis of the arc discharge during full temperature and pressure operation of the lamp. See also *A New Generation of Metal Halide Lamps,* by Koury, Gungle, and Waymouth, Journal of the Illuminating Engineering Society, January, 1975.

U.S. Pat. No. 4,056,751, by Gungle, et al, issued Nov. 1, 1977, discloses an improvement on the mentioned Koury patent wherein the electrodes are located approximately midway between the lower wall and longitudinal axis of the arc tube in order to reduce condensation of the metal halides at the ends of the arc tube during operation of the lamp. In this improvement, the upper and lower walls of the arc tube are substantially parallel, each wall having essentially the same degree of curvature.

Japanese Utility Model Publication No. 44-3499, published Feb. 7, 1969, discloses a lamp with an arched arc tube wherein the upper and lower walls of the arc tube are substantially parallel. Other types of arc discharge lamps have employed curved arc tubes. Arc discharge mercury lamps of approximately 60 years ago used curved arc tubes in order to keep separate the two pools of liquid mercury which served as electrodes.

Some capillary arc discharge lamps of approximately 40 years ago had a curved upper arc tube wall in a horizontal-operation lamp to prevent overheating of the middle of the arc tube. These lamps were very heavily loaded in comparison to current commerical metal halide lamps which have a loading of approximately 15 watts/sq. cm. The arc tubes of these capillary lamps had thicker walls and smaller bore than their current counterparts. In such capillary lamps, the arc discharge extended to the walls of the arc tube and was confined thereby. In contrast, the arc discharge of current metal halide lamps is not confined by the walls of the arc tube and the shape of the arc discharge may be affected by convection currents within the arc tube. In U.S. Pat. No. 2,190,657, issued Feb. 20, 1940, Germer discloses an arc tube comprising a curved upper wall and a flat lower wall having an interior bore narrow enough to confine the arc. Germer teaches that a curved upper wall will prevent overheating of the middle of the arc tube. Germer does not teach nor suggest that improved starting capabilities, efficacy, and lumen maintenance can be attained in a lamp having a non-capillary arc tube with a curved upper wall. In the Germer disclosure, the lower wall of the arc tube is flat and not determined by optimization of temperature profiles.

Curved arc tubes are also disclosed in the field of low pressure arc discharge lamps, such as low pressure sodium lamps and fluorescent lamps. It is common for such lamps to employ a U-shaped arc tube in order to conserve the space required for the lamp. Because these lamps are so lightly loaded, the length of the arc tube is much greater than would be required in a metal halide lamp of equivalent or even moderately increased wattage.

DISCLOSURE OF THE INVENTION

It is, therefore, an object of this invention to obviate the deficiencies in the prior art and to make a significant new contribution to the field of arc discharge lamps.

It is another object of the invention to improve the starting capabilities of arc discharge lamps for horizontal operation.

Another object of the invention is to improve the efficacy of arc discharge lamps for horizontal operation.

Another object of the invention is to improve the lumen maintenance of arc discharge lamps for horizontal operation.

These objects are accomplished, in one aspect of the invention, by the provision of an arched arc tube comprising a hermetically sealed light-emitting body with an enclosed cavity. The body has a central portion and opposed ends. The central portion is arched with two opposed walls forming the upper and lower walls of the arch. The upper wall and the lower wall are curved with the upper wall having a greater degree of curvature than the lower wall.

An electrode is sealed within each of the ends of the arc tube and protrudes into the body cavity. The internal positioning of the electrodes is such that there is a straight line-of-sight between the electrodes; that is, there is no interference by the lower wall of the arc tube.

Arc tubes constructed in accordance with the above-described parameters exhibit easier starting, improved efficacy, and improved lumen maintenance when compared with arched arc tubes of the prior art.

BEST MODE FOR CARRYING OUT THE INVENTION

For a better understanding of the present invention, together with other and further objects, advantages, and capabilities thereof, reference is made to the following disclosure and appended claims taken in conjunction with the above-described drawings.

Figure 1:
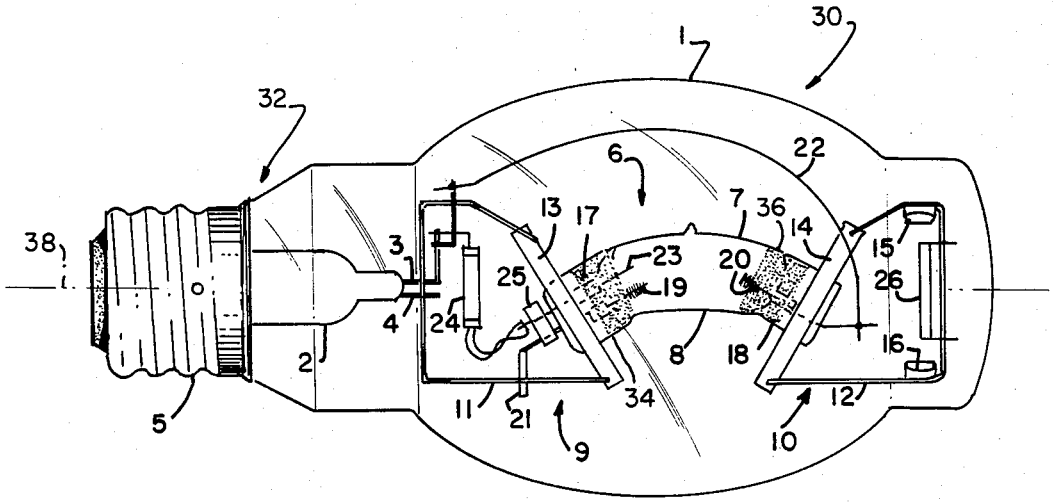
FIG. 1 is an elevational view of an arc discharge lamp employing an embodiment of the invention.

Referring to the drawings with greater particularity, FIG. 1 shows an arc discharge lamp 30 comprising an outer glass envelope 1 provided at its end 32 with a sealed reentrant stem 2 through which extend relatively stiff lead-in wires 3 and 4 connected at their outer ends to the electrical contacts of a positioning-type base 5. One kind of positioning-type base is a threaded mogul base with locator pin, as is shown in the drawing. Positioned within outer envelope 1 is a line-of-sight arc tube 6 comprising an upper wall 7 and a lower wall 8. The relationship between arc tube 6 and base 5 is such that when base 5 is properly inserted into a suitable socket the lamp will be in a substantially horizontal position with the arch of arc tube 6 uppermost.

Arc tube 6 is supported within outer envelope 1 by means of metal frames 9 and 10 at each end of arc tube 6. Metal frames 9 and 10 comprise rigid wires 11 and 12, respectively, to which are fastened clamps 13 and 14, respectively, each of which supports one of the pressed-seal ends 34 and 36 of arc tube 6. Clamps 13 and 14 are positioned angularly with respect to the horizontal axis 38 of outer envelope 1, as shown in the drawing, because of the arched shape of arc tube 6.

Metal frame 9 is supported by lead-in wire 4 to which it is welded. Metal frame 10 is supported by metal-leaf springs 15 and 16 which press against outer envelope 1. Heat-reflective coatings 17 and 18 can be applied to the ends of arc tube 6, as shown in the drawing.

Primary electrodes 19 and 20 are sealed within arc tube 6 and positioned such that a straight line may be drawn between primary electrodes 19 and 20 without being impeded by lower wall 8.

Electrical connection from lead-in wire 4 to primary electrode 19 is made through connective wire 21. Electrical connection from lead-in wire 3 to primary electrode 20 is made through connective wire 22. Electrical connection from lead-in wire 3 to the starter electrode 23 is made through resistor 24. Bimetal switch 25 shorts the starter electrode 23 to the adjacent primary electrode 19 after lamp ignition occurs.

The atmosphere within the outer envelope 1 can be a vacuum or an inert gas, such as nitrogen. Also positioned within outer envelope 1 is a getter 26 mounted on frame 10.

The fill within arc tube 6 can comprise mercury; an inert gas, for starting purposes; and one or more metal halides to improve the efficacy and color-rendering properties of the lamp.

Figure 2:
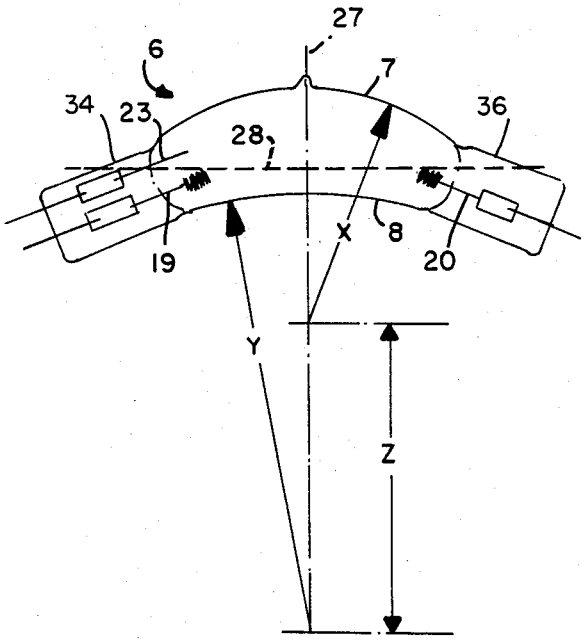
FIG. 2 is an enlarged elevational view of the arc tube utilized in the lamp of FIG. 1.

A preferred embodiment of arc tube 6 is shown in FIG. 2 Radius of curvature X of upper wall 7 is approximately 1.422 inches with the center (not labelled on the drawing) from which radius X emanates falling on vertical center line 27 of the arch. Radius of curvature Y of lower wall 8 is approximately 2.691 inches with the center (not labelled on the drawing) from which radius Y emanates falling also on vertical center line 27 of the arch. The center for radius X and the center for radius Y are approximately 1.927 inches apart on center line 27, as indicated by distance Z on the drawing.

Primary electrodes 19 and 20 are pressed into the tubular ends 34 and 36, respectively, of arc tube 6, as is conventional. These electrodes are positioned within arc tube 6 such that a straight line-of-sight 28, being shown as a horizontal dashed line on the drawing, exists between these electrodes without being impeded by lower wall 8.

For a description of the existing technology of the manufacture of a high intensity arched arc tube that could be used in the preferred embodiments of this invention, see U.S. Pat. No. 3,966,288, by Finch et al, issued June 29, 1976, and references cited therein.

It has been found that the shape of the arc discharge at full operating temperature and pressure is somewhat independent of the shape of the lower wall of the arc tube; further, a modification of the lower wall of the arc tube provides the lamp with improved starting capabilities and significantly enhanced efficacy and lumen maintenance. The modification of the arc tube comprises reducing the curvature of the lower wall such that the arc discharge at lamp start-up may follow along a straight line between the primary electrodes without being impeded by the lower wall of the arc tube.

An arched arc tube constructed as herein described may be referred to as a "line-of-sight" arc tube. The curvature of the lower wall of the arc tube with the constraint of allowing for the line-of-sight allows optimization of temperature profiles over the body of the arc tube, i.e., the variation in temperature is minimized over the body of the arc tube during full temperature and pressure operation of the lamp.

The reasons for the enhanced lamp performance compared with the parallel-sided arched arc tube are not totally understood. It is believed the following factors are significant. The line-of-sight achieved by the lower-wall contour provides a smaller gap between the primary electrodes at starting for the same operating arc length. During lamp warm-up, the arc discharge assumes its natural curve; it is not constrained to follow a parallel lower wall as in the prior technology. These factors minimize sputtering of the arc discharge during start-up. Also, lower-wall reactions during warm-up are minimized. As the lamp reaches full temperature and pressure, the arc discharge will assume an arched position substantially parallel to the upper wall of the arc tube so that none of the benefits of the prior technology are sacrificed.

Table 1, entitled *Efficacy and Maintenance of Line-of-Sight Lamp,* contains results of a series of tests conducted with two groups of lamps. The first group contained lamps with line-of-sight arc tubes; the second or control group contained lamps with conventional arched arc tubes with parallel walls. Each data column of the Table has two entries: "Eff." is the luminous efficacy in lumens per watt; "Main." is the lumen maintenance expressed as a percentage. The data in the Table show that the line-of-sight group of lamps had 12% higher luminous efficacy and 7% higher lumen maintenance after 6000 hours of operation.

TABLE 1

EFFICACY AND MAINTENANCE OF LINE-OF-SIGHT LAMP

| | CONVENTIONAL LAMP | | LINE-OF-SIGHT LAMP | |
|---|---|---|---|---|
| Length of Operation | Eff. | Main. | Eff. | Main. |
| 100 hr. | 99 | 100% | 103 | 100% |
| 1000 hr. | 84 | 85% | 88 | 85% |
| 2000 hr. | 70 | 71% | 80 | 85% |
| 4000 hr. | 66 | 67% | 72 | 70% |
| 6000 hr. | 60 | 61% | 67 | 65% |

To achieve the optimum benefits of the invention, it is necessary, of course, that the arch of the line-of-sight arc tube be uppermost during operation of the lamp. A positioning-type base insures that the arch of the arc tube will be uppermost when the line-of-sight lamp is horizontally inserted into a suitable socket.

Thus, there is provided an arc discharge lamp for horizontal operation with improved starting capabilities, efficacy, and lumen maintenance. The line-of-sight arc tube permits greater lamp efficiencies during the start and warm-up periods of operation while sacrificing none of the benefits realized by conventional arched arc tubes known to the prior art.

While there have been shown and described what are at present considered to be the preferred embodiments of the invention, it will be apparent to those skilled in the art that various changes and modifications can be made herein without departing from the scope of the invention as defined by the appended claims.

We claim:

1. A line-of-sight arched arc tube for horizontal operation having improved starting capabilities, improved efficacy, and improved lumen maintenance, said arc tube comprising:

(a) a hermetically sealed and light-emitting body with enclosed cavity, said body having a central portion and opposed ends, said central portion being arched with said arch being uppermost when said arc tube is positioned for horizontal operation, said central portion having two opposed walls forming the upper and lower walls of said arch, said upper wall having a greater degree of curvature than said lower wall, said lower wall having a degree of curvature greater than zero at all points thereon;

(b) a primary electrode sealed in each end of said body, said primary electrodes protruding into said body cavity and being positioned therein such that there is a straight line-of-sight between said electrodes without being impeded by said lower wall of said arch of said body;

(c) a fill within said body cavity, said fill being an electric-arc generating and sustaining medium; and (d) an arc discharge extending between said primary electrodes during full operating temperature and pressure, said arc discharge assuming an arched position substantially parallel to said upper wall, said arc discharge being the sole light-producing means within said arc tube.

2. The line-of-sight arched arc tube of claim 1 wherein said upper wall of said arch has a radius of curvature of approximately 1.4 inches, said lower wall of said arch hs a radius of curvature of approximately 2.7 inches, the centers from which said radii of curvature emanate being approximately 1.9 inches apart, said measurements being made on the vertical center line of said arch.

3. An arc discharge lamp for horizontal operation having improved starting capabilities, improved efficacy, and improved lumen maintenance, said lamp comprising:

(a) an arc tube having a hermetically sealed and light-emitting body with enclosed cavity, said body having a central portion and opposed ends, said central portion being arched with said arch being uppermost when said arc tube is positioned for horizontal operation, said central portion having two opposed walls forming the upper and lower walls of said arch, said upper wall having a greater degree of curvature than said lower wall, said lower wall having a degree of curvature greater than zero at all points thereon;

(b) a primary electrode sealed in each said end of said body, said primary electrodes protruding into said body cavity and being positioned therein such that there is a straight line-of-sight between said electrodes without being impeded by said lower wall of said arch of said body;

(c) a fill within said body cavity, said fill being an electric-arc generating and sustaining medium;

(d) an arc discharge extending between said primary electrodes during full operating temperature and pressure, said arc discharge assuming an arched position substantially parallel to said upper wall, said arc discharge being the sole light-producing means within said arc tube;

(e) an outer envelope, said arc tube being positioned and hermetically sealed within said outer envelope;

(f) means for supporting said arc tube within said outer envelope; and (g) means for providing electrical energy to said arc tube from an electrical source outside said outer envelope.

4. The arc discharge lamp of claim 3 wherein said lamp has a positioning-type base operatively attached to said outer envelope, said base being orientated with respect to said arc tube such that said lamp when in a horizontal position and installed properly in a suitable socket will be positioned with said arch uppermost.

5. The line-of-sight arched arc tube of claims 1 or 2 wherein said fill includes mercury, a metal halide, and an inert gas.

6. The arc discharge lamp of claims 3 or 4 wherein said fill includes mercury, metal halide, and an inert gas.

* * * * *